United States Patent [19]

Boone

[11] 4,007,996

[45] Feb. 15, 1977

[54] TURBINE ENGINE AND PUMP

[76] Inventor: Henry S. Boone, 2342 Midfield Drive, Montgomery, Ala. 36111

[22] Filed: Jan. 22, 1976

[21] Appl. No.: 651,296

[52] U.S. Cl. ..... 415/120; 415/198.1; 415/202

[51] Int. Cl.[2] ..... F04D 17/02

[58] Field of Search ..... 415/120, 199 R, 213 R, 415/219 C, 198, 202; 416/178, 179

[56] References Cited

UNITED STATES PATENTS

| | | | |
|---|---|---|---|
| 860,465 | 7/1907 | Hancock et al. | 415/213 R |
| 978,397 | 12/1910 | Rice | 415/213 R |
| 985,152 | 2/1911 | Fieroe | 416/178 |
| 1,649,161 | 11/1927 | Foster | 415/219 C |
| 2,293,590 | 8/1942 | Chance | 415/198 R |
| 2,429,978 | 11/1947 | Blanchard | 415/120 |

FOREIGN PATENTS OR APPLICATIONS

| | | | |
|---|---|---|---|
| 843,638 | 4/1939 | France | 415/120 |
| 9,448 | 1896 | United Kingdom | 415/198 R |
| 364,876 | 1/1932 | United Kingdom | 416/178 |
| 848,131 | 9/1960 | United Kingdom | 416/178 |

*Primary Examiner*—Henry F. Raduazo
*Attorney, Agent, or Firm*—Clarence A. O'Brien; Harvey B. Jacobson

[57] ABSTRACT

A turbine or pump having a housing receiving a rotor journaled therefrom by a central shaft with the housing including a tangential inlet and a tangential outlet extending in opposed directions with the rotor including a central partition in the housing and curved blades on each side of the partition. The partition is provided with a central opening which communicates the inlet side of the partition with the outlet side thereof whereby fluid passes radially inwardly in engagement with the blades on the rotor to the radial central portion of the partition adjacent the shaft and then makes a U-turn and moves radially outwardly of the partition in relation to the blades for discharge.

4 Claims, 4 Drawing Figures

TURBINE ENGINE AND PUMP

BACKGROUND OF THE INVENTION

1. Field of the Invention

The present invention generally relates to a power device and more particularly a fluid pressure operated turbine or a pump for pumping fluids which includes a housing and rotor assembly in which the rotor is divided into intake and outlet surfaces communicated at the center by an opening through the partition plate which defines a portion of the rotor and which has curved blades on each surface thereof.

2. Description of the Prior Art

Many efforts have been made to provide turbines or pumps in which a rotor is journaled in a housing provided with inlets and outlets with the rotor including blade structures which will impart torque to a central shaft when acting as a turbine or which will pump a fluid when the central shaft is rotated. Various structures have been provided which utilize known fluid flow characteristics in which axial flow or radial flow of the fluid occurs. Typical of such devices are multiple stage turbines in which fluid pressure flows axially of a housing and past a plurality of rotors having blades mounted thereon. Another type of structure which is quite common is a radial flow centrifugal pump where a rotating impeller having blades on one side thereof will cause radial and tangential discharge flow of a fluid which has a central intake. Various practical applications have been made of such devices in both the turbine field and the pump field.

SUMMARY OF THE INVENTION

An object of the present invention is to provide a turbine or pump utilizing both radial and axial flow with fluid flow through the device incorporating a combination of initial radial flow, then axial flow parallel to the axis of the power shaft and subsequent radial flow to discharge.

Another object of the invention is to provide a turbine or pump incorporating a rotor within a housing in which the rotor is provided with a central partition and curved blades on each side thereof with the two sides of the rotor being communicated by a central open area adjacent the rotational axis of the rotor by which fluid flow may be radially inwardly on one side of the partition, through the opening and radially outwardly along the other side of the partition.

Still another object of the invention is to provide a turbine or pump including a housing with removable end plates and a rotor rotatably journaled therein with the rotor and housing being provided with such close tolerances that the fluid pressure will be substantially sealed but yet the rotor will not bind during rotation.

Yet another important object of the invention is to provide a turbine or pump capable of many installations which will effectively provide desired torque on the output shaft or pump desired quantities of fluid when the rotor shaft is driven.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
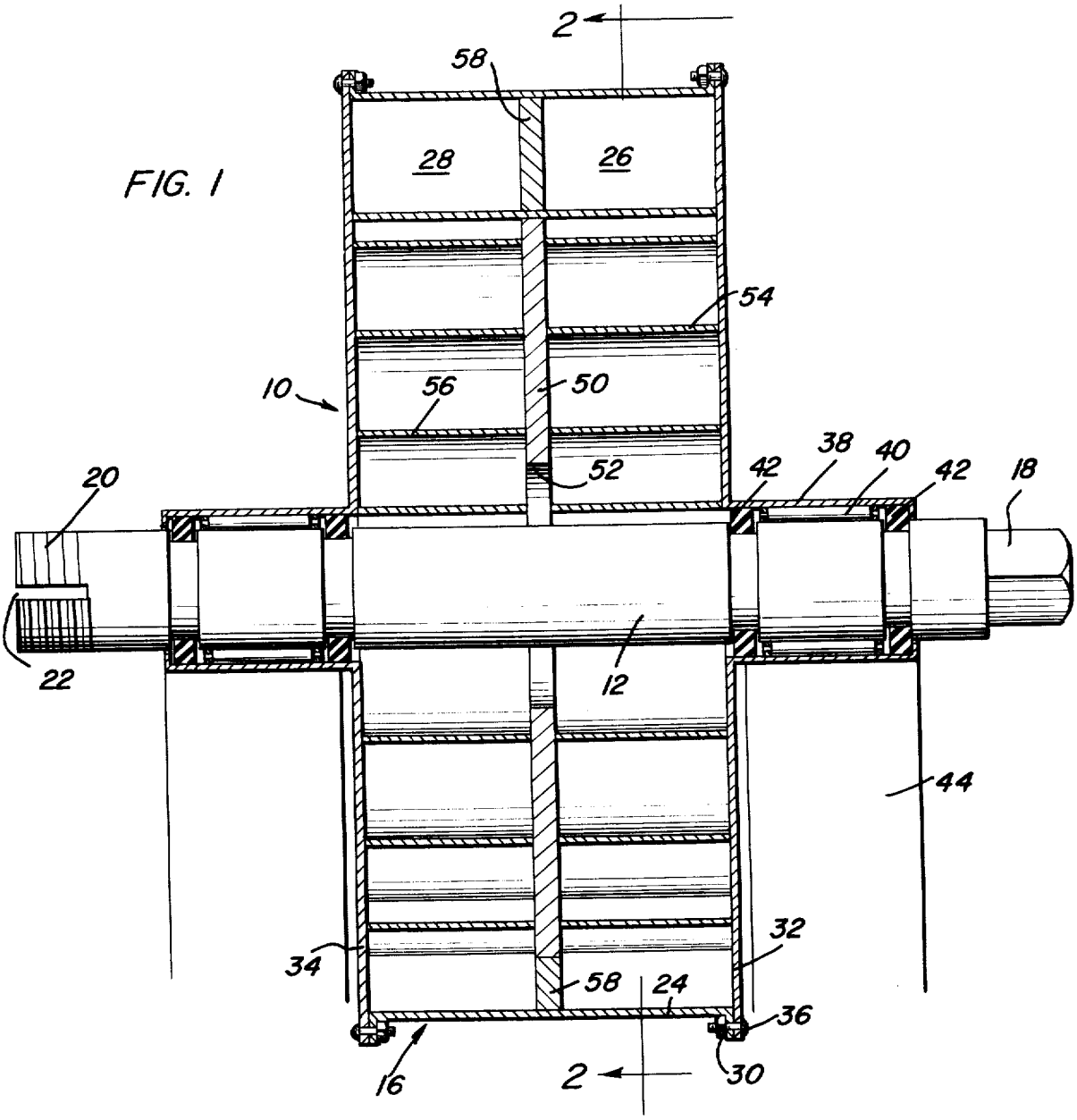
FIG. 1 is a vertical sectional view of the turbine or pump of the present invention.

Referring now specifically to the drawings, the turbine or pump of the present invention is generally designated by numeral 10 and includes a central shaft 12 of cylindrical configuration or the like on which is attached a rotor generally designated by numeral 14 rotatably received within a stationary housing generally designated by numeral 16.

The shaft 12 is of any suitable size and preferably cylindrical in configuration with the ends of the shaft extending axially from the housing 16 and provided with a square or polygonal end 18 from which power may be taken or into which power may be connected. The other end of the shaft 12 is threaded as at 20 and provided with a longitudinal keyway 22 therein further providing means for taking power off the shaft 12 or putting power into the shaft 12 by any suitable gear, pulley or other mechanical means.

The housing 16 includes a peripheral external wall 24 having a cylindrical portion and a tangential portion 26 forming an intake and an oppositely extending tangential portion 28 forming an outlet. Detachably connected to outturned flanges 30 on the wall 24 are end plates 32 and 34 with suitable fasteners 36 being provided for detachably securing the end plates 32 and 34 to the peripheral wall flange 30 with suitable seal means being provided therebetween. Centrally of each of the end plates 32 and 34, a projecting cylindrical bearing housing 38 is provided for journaling a bearing assembly 40 therein in which a portion of the shaft 12 is supported with suitable seal means 42 being provided internally and externally of the bearing assembly 40 for sealing the bearing. The bearing assembly and seal assembly may be any conventional bearing structure and seal structure capable of supporting the rotor and shaft and sealing the bearing assembly from fluid in the turbine or pump and sealing the bearing assembly from external contaminants. For supporting the housing 16, the cylindrical members 38 are provided with depending support structures 44 provided with suitable mounting flanges 46 or the like by virtue of which the device may be supported in any suitable manner. The specific construction of the support and the specific construction of the bearing assembly as well as the specific manner in which power is applied to or taken from the shaft may vary depending upon the installational requirements for each individual installation.

Figure 2:
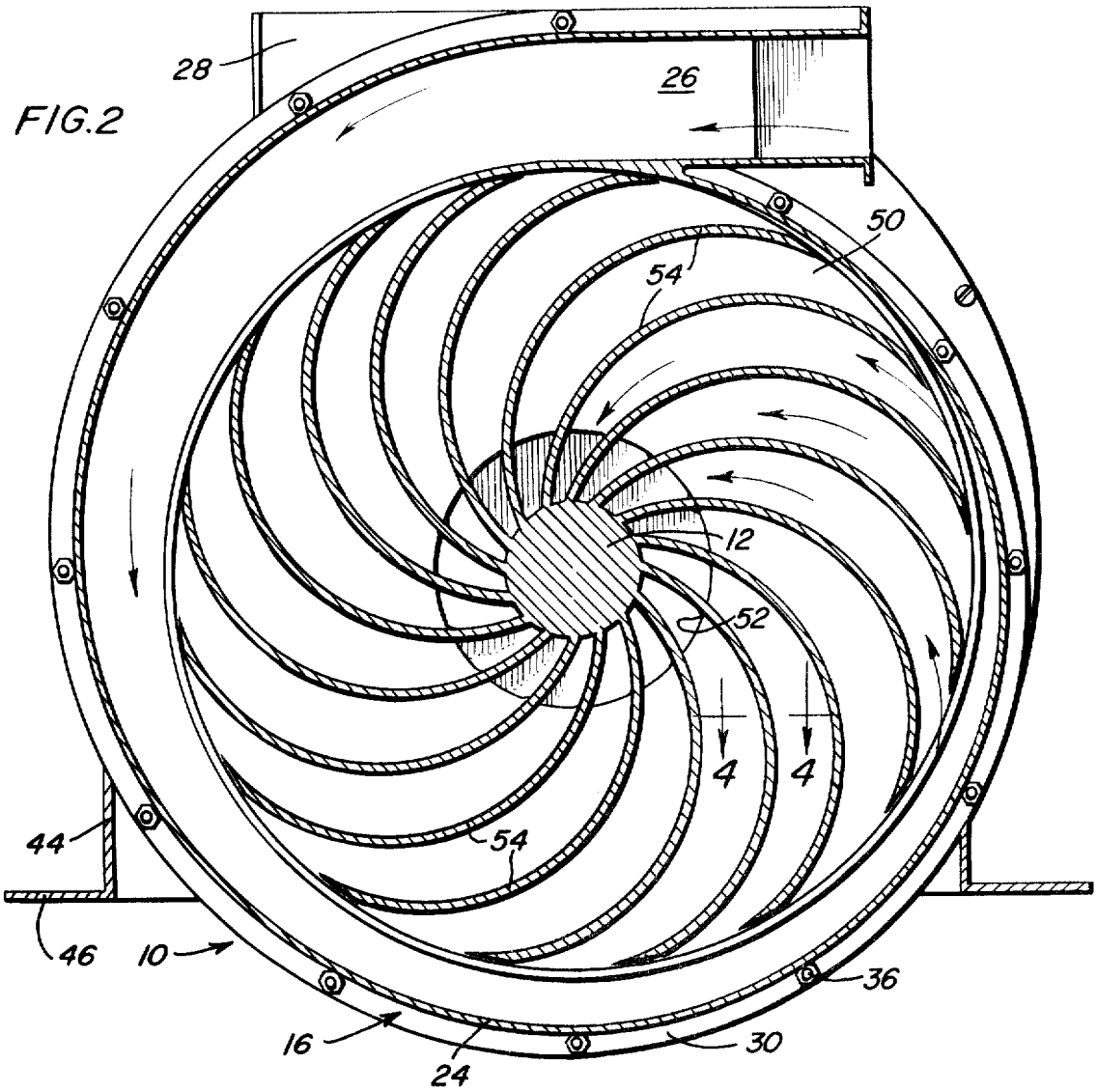
FIG. 2 is a vertical sectional view taken substantially upon a plane passing along section line 2—2 of FIG. 1 illustrating the curve construction of the rotor blades and the association of the central shaft, opening and tapering channel leading tangentially from the periphery of the housing.
Figure 3:
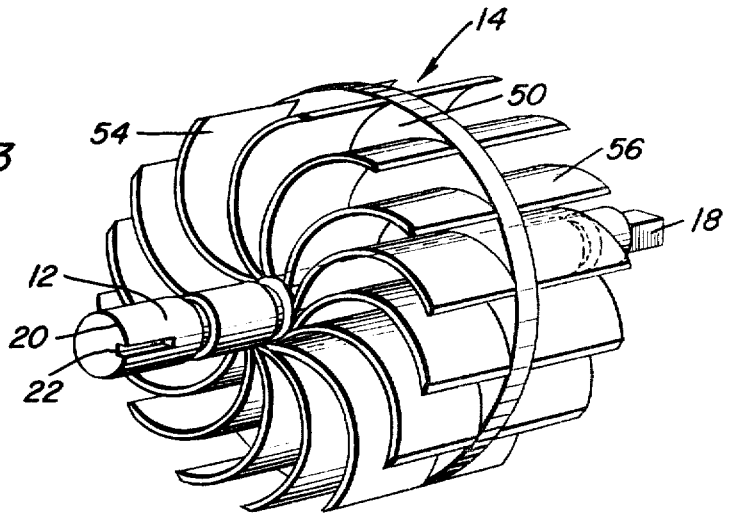
FIG. 3 is a perspective view of the rotor.

The rotor 14 includes a circular, centrally disposed partition plate 50 having a central opening 52 therein which is disposed in concentric spaced relation to the shaft 12 as illustrated in FIG. 2. Rigid with the surface of the partition plate 50 which is in alignment with the intake 26, as illustrated in FIG. 1, is a plurality of arcuately curved blades 54 which extend inwardly from the periphery of the plate 50 to the shaft 12 with the inner ends of the blades 54 either being fixedly secured to the shaft or fixedly secured to a sleeve which is keyed to the shaft. Secured to the other surface of the partition plate is a plurality of arcuately curved blades 56 which are associated with the plate 50 in the same manner as the blades 54 so that the rotor components including the plate 50 and blades 54 and 56 are of one-piece or integral construction with the opening 52 defining communication between the intake side of the partition plate 50 and the outlet side thereof. As illustrated in FIG. 1, the peripheral wall 24 is provided with a stationary partial partition plate 58 rigid or integral therewith to maintain separation between the intake and outlet sides of the housing 16.

Figure 4:
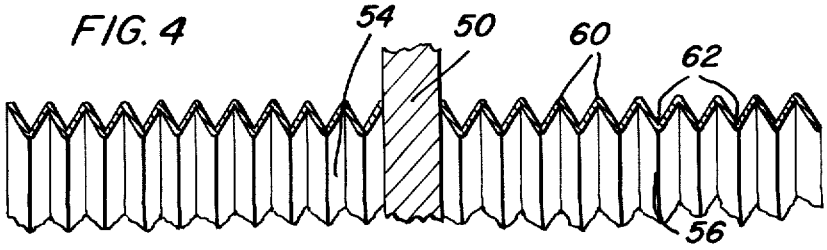
FIG. 4 is an enlarged sectional view of the rotor blades illustrating the V-shaped striations incorporated longitudinally in the blades.

As illustrated in FIG. 4, the blades 54 and 56 on the partition plate 50 are each provided with V-shaped striations or ridges and valleys 60 and 62 which not only rigidify the blades but also increase the surface area thereof which is contacted by fluid as it passes through the turbine or pump. The striations extend from the outer edges of the blades in generally a parallel relation to the surfaces of the plate 50 and terminate at the outer edge of the opening 52 so that fluid flow from the outer side edge of the blade at its inner end will not be hindered thus enabling maximum flow through the opening 52.

The rotor will fit the housing with minimum necessary operative tolerance inside the peripheral curved wall 24 and the end plates 32 and 34 with the end plates being adjustable to closely fit the turbine and at the same time be sealed to the side edges of the peripheral wall 24. The peripheral wall of the housing is of course curved in a manner to form intake channels and discharge channels of a tapering cross-sectional configuration. The lengthwise striations in each of the two sets of rotary blades enables each of the blades to expose approximately twice as much surface area to the high temperature and/or high pressure and/or high velocity fluid thus collecting approximately twice as much energy therefrom. Further, the striations expose such surface for a longer period of time and for a greater distance thereby producing further efficiencies.

Fluids, such as liquids coming into the intake 26 will move inward past the tips of the blades throughout the tapering configuration of the intake 26, that is, around a substantial portion of the rotor. Such fluid will then move inwardly to impart torque to the rotor and then make a U-turn at the shaft and then radially outwardly in a spiral path for discharge from the tips of the blades 56 on the discharge side of the rotor and out through the outlet 28 thus imparting further rotational torque to the rotor in the same direction as the torque imparted thereto by engagement of the fluid with the blades 54 on the intake side of the rotor. This is somewhat akin to multiple sets of blades in an axial flow turbine in which the fluid changes directions so that torque is imparted during both radial movements of the fluid in relation to the housing and rotor.

The outside wall 24 which defines the intake channels and outlet channels are curved in such a manner that a spiral curve is defined having a transverse rectangular shape in which the greater dimension is approximately twice the shorter dimension as illustrated in FIG. 1. This arrangement spreads the maximum possible fluid particles against the tips and adjacent portions of the blades in order to utilize a maximum portion of the energy contained in high temperature, pressure or velocity fluids. Any energy in the fluid discharged from the device may, of course, be utilized in other manners to minimize waste.

The same basic arrangement may be employed for pumping a fluid or liquid at a desired pressure but in a pump arrangement, the curvature of the blades 54 is reversed, that is, the concave side thereof will be the leading surface of the blades 54 rather than the trailing surface as illustrated in FIG. 2. The blades 56 will operate so that the convex surface of the blades 56 will be the leading edge for discharging liquid from the discharge outlet 28. The inner end portions of the blades 54 and 56 should be radially straight from the periphery of the opening 50 inwardly toward the center of the shaft 12.

All of the blades of the turbine engine are curved over the entire lengths thereof from the tips to the perimeter of the shaft with openings between them around the perimeter of the shaft for the liquid to pass through. Thus energy of and from the individual speeding liquid material particles may and will pass from such particles to the solid material blades at the speed of light on a straight line through the center of gravity of such particles and perpendicular to the blades at the point of entry thereof forcing the blades around the center of the shaft.

When the blades are force pumping, the liquid energy goes from the blades at the speed of light to the individual material particles of the liquid on a straight line perpendicular to the blade face and extending straight through the center of gravity of the individual liquid particles. Thus it is best in the pumping arrangement for all of the blades to be straight from the outer edge of the opening 52 between them to the center of the shaft. It is best that the concave faces of the blades on the intake or inflow side of the partition force the individual particles and the total of the liquid to, into and through the opening 52 and the convex faces of the blades on the output or outflow side of the partition give individual particles and the total of the liquid additional speed energy and/or pressure.

In the pump, the blades are straight from the openings in the partition between these to the center of the shaft, the blades on the liquid outlet or outflow side of the partition are curved in the opposite direction and the liquid intake or inflow should pass by the concave faces of the blades and the liquid outlet or outflow should pass by the convex faces of the blades.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A fluid pressure device in the form of a turbine or pump comprising a housing defined by spaced parallel end plates interconnected by a peripheral wall having a constant diametric dimension from end to end thereof, a rotor disposed within the housing, a shaft centrally located with respect to the rotor and being journaled in said end plates, said housing including a tangential inlet and outlet with the peripheral wall spiralling inwardly from the inlet and outlet to provide a tapering converging inlet channel and diverging outlet channel extending around a major of the periphery of the housing with the inlet and outlet being oppositely disposed, said rotor including a central, circular partition plate, a plurality of equal length and width radial blades on each side of said partition plate, the outer ends of the blades coinciding with the periphery of the partition plate, said partition plate including a centrally disposed opening enabling passage of fluid therethrough whereby fluid enters the inlet, travels radially inwardly along one surface of the partition plate, make a U-turn through the opening in the partition plate and then radially outwardly along the other side of the partition plate for discharge through the outlet, said peripheral wall of the housing having an inwardly extending peripheral partition member conforming with and closely spaced in aligned relation to the partition plate on the rotor to divide the rotor and housing into inlet and outlet portions, the inner ends of said blades extending inwardly of the periphery of the opening in the partition plate and being rigid with said shaft.

2. The structure as defined in claim 1 wherein said blades on at least one side of the partition plate are arcuately curved and having a diameter substantially equal to the radius of the partition plate.

3. The structure as defined in claim 1, wherein said blades are provided with longitudinal, V-shaped striations from their outer end edges to the periphery of the central opening.

4. The structure as defined in claim 1 wherein said blades are arcuately curved in the same direction on both sides of the partition plate.

* * * * *